US005139248A

United States Patent [19]

Kishine et al.

[11] Patent Number: 5,139,248

[45] Date of Patent: Aug. 18, 1992

[54] PRINTED PAPER FOLDING APPARATUS

[75] Inventors: Toshiaki Kishine; Mikio Yoshikawa; Hidetoshi Ito, all of Chiba; Hiroyuki Takano, Funabashi; Masatoshi Yasuda, Chiba, all of Japan

[73] Assignee: Miyakoshi Printing Machinery Co., Ltd, Japan

[21] Appl. No.: 651,569

[22] Filed: Feb. 6, 1991

[30] Foreign Application Priority Data

Feb. 7, 1990 [JP] Japan ..... 2-25931
Feb. 7, 1990 [JP] Japan ..... 2-25932
Feb. 7, 1990 [JP] Japan ..... 2-25933

[51] Int. Cl.[5] ..... B41L 1/32

[52] U.S. Cl. ..... 270/39; 270/211; 270/525; 493/353; 493/359

[58] Field of Search ..... 270/21.1, 39, 40, 52, 270/52.5, 41, 58; 493/359, 353, 360, 357, 372, 482, 454

[56] References Cited

U.S. PATENT DOCUMENTS 4,288,278 9/1981 Akao ..... 156/474
4,508,527 4/1985 Uno ..... 270/40
4,747,591 5/1988 Beyer ..... 270/52.5
4,750,724 6/1988 Herd ..... 270/39
4,778,165 10/1988 Buck ..... 270/39
4,842,573 6/1989 Peter ..... 270/39
4,871,157 10/1989 Hermann ..... 270/52.5
4,917,365 4/1990 Stemmler ..... 270/39

FOREIGN PATENT DOCUMENTS 0278120 10/1987 European Pat. Off. .

*Primary Examiner*—Edward K. Look
*Assistant Examiner*—Therese M. Newholm
*Attorney, Agent, or Firm*—Ronald P. Kananen

[57] ABSTRACT

The present invention relates to a printed paper folding apparatus comprising: conveyor means provided from the upstream side of a folded paper conveying path located below a folder unit to a folded paper cutting position on the downstream side thereof so as to convey a sheet of printed paper which is folded and discharged by the folder unit in a zigzag fashion; a folded paper separating position indicating device provided along the paper conveying path so as to indicate separating positions at intervals of a predetermined number of folds of the printed paper which is folded and discharged by the folder unit; a folder paper cutting device provided by the cutting position so as to automatically cut the paper, which is continuously conveyed by the conveyor means along the conveying path, into an upstream portion and a downstream portion relative to the conveying path; and a paper sorting device provided near the cutting position so as to automatically sort the upstream portion of the paper from the downstream portion thereof.

4 Claims, 10 Drawing Sheets

PRINTED PAPER FOLDING APPARATUS

BACKGROUND OF THE INVENTION

1. Field of the Invention

This invention relates to a printed paper folding apparatus installed on the downstream side of a rotary press and adapted to fold a sheet of paper which is continuously printed by the rotary press in a zigzag fashion, and more particularly to a printed paper folding apparatus comprising a folded paper separating position indicating device for clearly indicating separating positions at intervals of a predetermined number of folds of the folded paper; a folded paper cutting device for cutting the folded paper at each of the separating positions into upstream and downstream portions; and a folded paper sorter device for sorting out the upstream portion of the paper from the downstream portion thereof at the above-mentioned cutting position.

2. Description of the Prior Art

In case of indicating separating positions at intervals of a predetermined number of folds on a continuous sheet of printed paper which is folded in a zigzag fashion and discharged by a folder unit onto discharge conveyor means, it has been a common practice to indicate the separating positions on the printed paper by means of a solenoid actuated type marking device installed on the folder unit. Further, cutting of the printed, folded paper has so far been made by an operator using a manually operable cutter at a position downstream of the discharge conveyor means.

In case indication of separating positions is made by the above-mentioned prior art marking device, printed products are applied with marks, and therefore some parts of the products have become unavoidably unusable. Also, changes in conveying speed have caused some error in the number of folds of the paper. Further, since a mark is applied continuously by such a marking device over several folds on the folded paper, it has been difficult to indicate or mark separating positions on the folded paper accurately at intervals of a predetermined number of folds.

Further, in case the folded paper is cut by the operator along perforations at the indicated or marked separating positions, the cutter is applied from the side edge of the paper to each of the perforations applied with marks according to his eye measurement, and therefore it has been difficult to cut the paper accurately at intervals of a predetermined number of folds.

Still further, where the sorting operation of the folded paper after completion of the cutting has also been made manually by the operator, the sorting operation has posed a problem in that it is troublesome to carry out and requires much labor.

SUMMARY OF THE INVENTION

The present invention has been made in view of the above-mentioned deficiencies in the prior art, and has for its object to provide a paper separating position indicating device for use with a printed paper folding apparatus arranged such that accurate indication of separating positions of the paper corresponding to cutting positions thereof can be made by inserting a paper separating spatula for indicating separating positions in a predetermined fold of the paper which is folded in a zigzag fashion and discharged by a folder unit and moving the spatula together with the movement of the folded paper.

Further, another object of the present invention is to provide a folded paper cutting device for use with a printed paper folding apparatus, which is capable of automatically cutting a continuous sheet of printed paper completely and accurately at intervals of a predetermined number of folds.

A further object of the present invention is to provide a folded paper sorter device for use in a printed paper folding apparatus arranged such that cutting and sorting of a folded paper at the cutting position can be made automatically without resort to manual operations so that the labor or manpower required for these operations can be reduced considerably, and the cutting and sorting operations can be conducted extremely systematically.

To achieve the above-mentioned objects, according to a first aspect of the present invention, there is provided a printed paper folding apparatus comprising conveyor means provided from the upstream side of a folded paper conveying path located below a folder unit to a folded paper cutting position on the downstream side thereof so as to convey a sheet of printed paper which is folded and discharged by the folder unit in a zigzag fashion; a folded paper separating position indicator device provided along the paper conveying path so as to indicate separating positions at intervals of a predetermined number of folds of the printed paper which is folded and discharged by said folder unit; a folded paper cutting device provided at the cutting position so as to automatically cut the printed paper, which is continuously conveyed by the conveyor means along the paper conveying path, into an upstream portion and a downstream portion in relation to the paper conveying path; and a folded paper sorter device provided in the vicinity of the cutting position so as to automatically sort out the upstream portion of the paper from the downstream portion thereof at the cutting position.

According to a second aspect of the present invention, there is provided a printed paper folding apparatus as set forth in the above-mentioned first aspect, wherein the folded paper separating position indicating device comprises: a pair of rails provided on both breadthwise sides of the folder unit so as to extend from the upstream side of the paper conveying path to the downstream side thereof, the rails being arranged such that they may be turned vertically about their downstream end portions as their respective fulcrums, and also moved towards and away from each other in opposite directions in parallel relationship; two sliding pieces each being slidably engaged with these rails; slidable driving means for slidably moving these sliding pieces along the rails in synchronism with each other; printed paper separating spatulas mounted on these sliding pieces, respectively, such that they may be turned freely, and adapted to be inserted into a predetermined fold of the printed paper, which is folded and discharged by the folder unit, from the upstream side of the paper conveying path; upstream spatula posture control means provided on the upstream end portions of the pair of rails, respectively, so as to control the paper separating spatulas when they are located on the upstream side so that they may assume a posture for insertion into the predetermined fold of the printed paper; downstream spatula posture control means provided on the downstream end portions of the pair of rails, respectively, so as to control the paper separating spatulas when they are located on the downstream side so that they may assume such a posture as to slope upwards towards the downstream side; position detecting sensors provided on the upstream and downstream ends of each of the pair of rails so as to detect the position of the paper separating spatula; and paper separating spatula inserting means provided on the upstream end of each of the pair of rails so as to insert the paper separating spatula into a predetermined fold of the printed paper at intervals of a predetermined number of folds of the printed paper, which is folded by the folder unit, when each of the sliding pieces is located at its upstream end.

According to a third aspect of the present invention, there is provided a printed paper folding apparatus as set forth in the above-mentioned first aspect, wherein the folded paper cutting device comprises: guide frames extending further downstream from the downstream ends of the pair of rails located in the vicinity of the folded paper cutting position, each of the guide frames being fixedly secured to the upper end of each of a pair of upstanding leg portions mounted on a body frame in such a manner that they may be slidably moved up and down from the body frame; a movable frame mounted on the upper surfaces of the guide frames in such a manner that it may be moved freely in the direction of conveyance of the printed paper and in the opposite direction thereof; a cutter bed provided on the upstream side of the movable frame in such a manner that it may be moved transversely or widthwise in a range longer than the width of the printed paper; a cutter fixedly secured to the cutter bed in such a manner that it may assume a posture coincident with the posture of the paper separating spatulas, respectively, located at the downstream ends of the rails when the cutter bed is located at its downstream end position; guide frame moving means for moving up and down the pair of leg portions whose top ends are fixedly secured to the guide frames; a cutter bed moving means for moving the cutter bed longitudinally and transversely in the direction of conveyance of the folded paper; and a folded paper level detecting sensor fixedly secured to the movable frame so as to project therefrom towards the upstream side and adapted to detect the level of the folded paper at the folded paper cutting position.

Further, according to a fourth aspect of the present invention, there is provided a printed paper folding apparatus as set forth in the above-mentioned first aspect, wherein the folded paper sorter device comprises: guide frames extending further downstream from the downstream ends of the pair of rails located in the vicinity of the folded paper cutting position, each of the guide frames being fixedly secured to the upper end of each of a pair of upstanding leg portions mounted on a body frame in such a manner that they may be slidably moved up and down from the body frame; a movable frame mounted on the upper surfaces of the guide frames in such a manner that it may be moved freely in the direction of conveyance of the printed paper and in the opposite direction thereof; a cutter bed provided on the upstream side of the movable frame in such a manner that it may be moved transversely or widthwise in a range longer than the width of the printed paper; a cutter fixedly secured to the cutter bed in such a manner that it may assume a posture coincident with the posture of the paper separating spatulas, respectively, located at the downstream ends of the rails when the cutter bed is located at its downstream end position; guide frame moving means for moving up and down the pair of leg portions whose top ends are fixedly secured to the guide frames; a cutter bed moving means for moving the cutter bed longitudinally and transversely in the direction of conveyance of the folded paper; a folded paper level detecting sensor fixedly secured to the movable frame so as to project therefrom towards the upstream side and adapted to detect the level of the folded paper at the folded paper cutting position; and an inverted-U shaped comb plate mounted on the movable frame in such a manner that it may be moved vertically, and also from an inserting position towards the upstream side through the action of driving means so as to be inserted from above in between the upstream and downstream portions of the paper, which have been cut off, at a position downstream of the cutter when said cutter bed is moved to its upstream end position and also moved to the breadthwise intermediate position of the printed paper, and wherein the paper conveying speed of the conveyor means located from the folded paper cutting position to the downstream side is kept higher than that of the conveyor means installed on the upstream side.

Advantages of the printed paper folding apparatus according to the present invention incorporating the above-mentioned aspects are as follows:

Cutting/separating positions at intervals of a predetermined number of folds of a sheet of paper which is folded by a folder unit in zigzag shape can be indicated accurately, and also the folded paper can be cut automatically and easily by operating the cutter at each of the indicated cutting/separating positions.

Further, cutting and sorting operations of the folded paper at the cutting position are automatically conducted without resort to manual operations so that the manpower required for these operations can be reduced considerably, and also the cutting and sorting operations can be conducted extremely regularly.

The above-mentioned and other objects, aspects and advantages of the present invention will become apparent to those skilled in the art by making reference to the following description and the accompanying drawings in which preferred embodiments incorporating the principles of the present invention are shown by way of example only.

DETAILED DESCRIPTION OF THE PREFERRED EMBODIMENT

Figure 1:
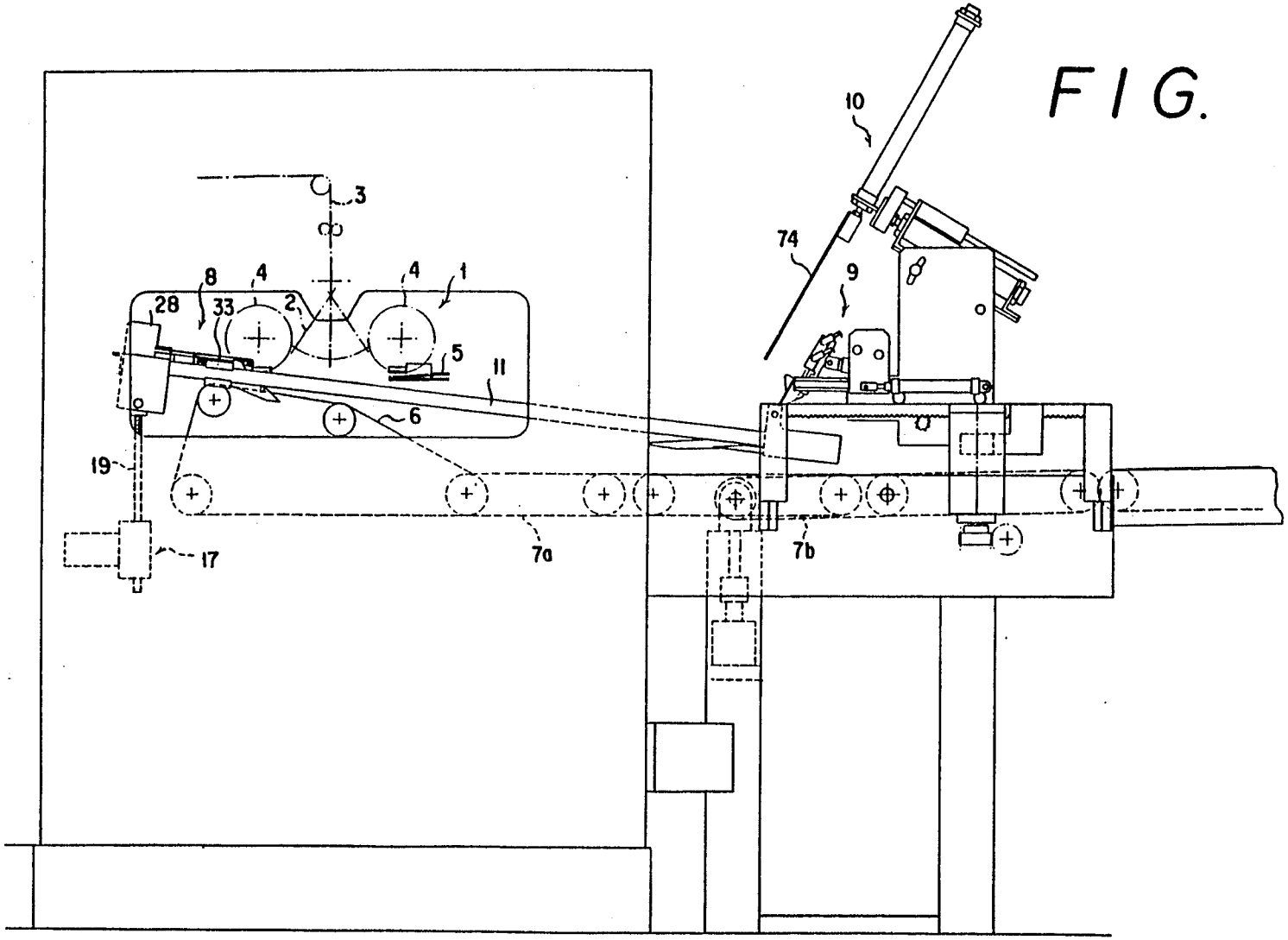
FIG. 1 is an overall, schematic side elevational view showing one embodiment of the present invention.

One embodiment of the present invention will now be described in detail below with reference to the accompanying drawings.

In the drawings, reference numeral 1 denotes a folder unit arranged such that a sheet of printed paper 3 discharged from a pendulum nozzle 2 is folded by beaters 4 and screws 5 along perforations made previously by a perforator device in a zigzag fashion, and then discharged onto a receiving belt 6. Reference numerals 7a and 7b denote a first conveyor belt and a second conveyor belt which are connected in series with the receiving belt 6. The second conveyor belt 7b is arranged such that it can be tilted from a position flush with the first conveyor belt 7a to a position wherein the upstream end thereof is raised.

A folded paper separating position indicating device 8 is provided so as to extend from a position below the folder unit 1 to another position where the first conveyor belt 7a is connected to the second conveyor belt 7b. Further, provided above the position where the first conveyor belt 7a is connected to the second conveyor belt 7b is a cutting device 9 for cutting the folded paper 3 along a fold at each of the separating positions indicated by the folded paper separating position indicating device 8, and a sorter device 10 for longitudinally sorting the upstream portion of the paper 3 cut off by the cutting device 9 from the preceding portion thereof at the cutting position.

The above-mentioned folded paper separating position indicating device 8 is constructed as shown in FIGS. 2 to 6. This separating position indicating device 8 is of a symmetrical configuration on both sides in the direction of breadth of the folder unit 1, and therefore only one side thereof C on this side in the direction of breadth) will be described hereinbelow.

Reference numeral 11 denotes a rail which extends from a position on the upstream side of the paper folding position of the folder unit 1 to another position on the downstream portion of the cutting device 9, and which can be turned clockwise and counterclockwise about its downstream end portion which acts as its fulcrum.

Stating more specifically, fixedly secured to one side of the upstream end portion of the rail 11 is a bracket 12 which is supported by a rotating shaft 13 and a guide rod 14 so that it may be freely and slidably moved in the breadthwise direction. The rotating shaft 13 extends breadthwise, and both ends thereof are rotatably supported by elevating side plates 15. Further, the base end of the guide rod 14 is fixedly secured to one of the elevating side plates 15. The elevating side plates 15 are vertically movable along the inside of frames 16 installed on both sides in the breadthwise direction. The lower portion of the elevating side plate 15 is connected to the upper end of an elevator device 17 in such a manner that it may be slidably moved freely in the breadthwise direction. The elevator device 17 is comprised of a screw-threaded rod 19 adapted to be rotated by a motor 18 fixedly secured to the frame 16, and a connecting member 20 engaged threadably with the leading end of the screw-threaded rod 19. The connecting member 20 is connected to the lower portion of the elevating side plate 15 so that it may be turned freely.

The downstream end portion of the above-mentioned rail 11 is slidably supported by a guide rod 21 provided in the breadthwise direction. Further, the base end of the guide rod 21 is fixedly secured to a swingable frame 22 which is swingably supported by a guide frame 50 of the cutting device 9 which will be described later. Further, the rail 11 has a bracket 23 fixedly secured to one side surface of the downstream end portion thereof.

The bracket 12 fixedly secured to the upstream end portion of the rail 11 is connected to the elevating side plate 15 by an offsetting cylinder means 24a, whilst the bracket 23 fixedly secured to the downstream end portion of the rail 11 is connected to the swingable side plate 22 by an offsetting cylinder means 24b. The arrangement is made such that when the piston rods in the cylinder means 24a and 24b are extended or retracted the rail 11 is moved in parallel with the breadthwise direction of the folder unit 1 along the rotating shaft 13 and both the guide rods 14 and 21.

Within the above-mentioned rail 12 a feed screw-threaded rod 25 is mounted in parallel thereto and its both ends are supported by the rail 11. The upstream end portion of the feed screw-threaded rod 25 is connected through the intermediary of a bevel gear mechanism 26 to the above-mentioned rotating shaft 13. The rotating shaft 13 is connected through the intermediary of a gear arrangement 29 to a motor 28 supported on a bed 27 fixedly secured to the frame 16.

The above-mentioned feed screw-threaded rod 25 has a first feed piece 31 and a second feed piece 32 threadably engaged therewith and which are axially spaced apart by a distance L. Further, the feed pieces 31 and 32 are arranged such that they may be slidably moved within the rail 11 without rotation. A sliding piece 33 is engaged with the rail 11 so that it may be slidably moved longitudinally along the rail 11 when it is pushed by either one of the feed pieces 31 and 32. Further, whenever the sliding movement of the sliding piece 33 by one of the feed pieces 31 and 32 is changed over to that by the other, it is required for the sliding piece 33 to move by an idle stroke "l".

A support shaft 34 projects from one side of the sliding piece 33, and a turning lever 35 is pivotally mounted on the support shaft 34 so that it may be turned freely in a direction along the rail 11. The base portion of a folded paper separating spatula 36 is pivotally mounted on the leading end of the turning lever 35 so that it may be turned freely. The folded paper separating spatula 36 projects in the direction of the breadth of the folder unit 1, and a cutter guiding portion 36a which is comprised of two opposed and spaced-apart tongues is provided on the breadthwise outside of the folder unit 1.

The brackets 12 and 23 fixedly secured to both ends of the rail 11 are provided with posture controlling cam mechanisms 37a and 37b, respectively, which serve to control the posture of the turning lever 35 supporting the folded paper separating spatula 36, and the posture of the folded paper separating spatula 36, respectively.

The posture controlling cam mechanism 37a provided on the upstream side serves to raise up the turning lever 35 and keep the folded paper separating spatula 36 in parallel with the rail 11, and comprises a guide rod 38 which is brought in contact with the upper surface of the folded paper separating spatula 36, and a guide cam 40 which is brought into contact with pins 39a and 39b fitted to the turning lever 35.

Also, the posture controlling mechanism 37b provided on the downstream side serves to raise up the turning lever 35 and fixedly secure the folded paper separating spatula 36 in such a way as to slope upward towards the downstream side, and comprises guide cams 41a and 41b which are brought into contact with the pins 39a and 39b, respectively, that are fitted to the turning lever 35, and a fork-shaped positioning member 42 adapted to engage with an engaging projection 36a provided on one end of the folded paper separating spatula 36 to thereby control the posture of the engaging projection 36a and effect positioning thereof. The positioning member 42 is arranged so that it may be slidably moved in the upstream and downstream directions, and supported by a spring 43.

Mounted on the upper surface of the upstream end portion of the rail 11 is a cylinder means 44 for the purpose of inserting the spatula, which serves to push the sliding piece 33 located on the above-mentioned upstream end portion of the rail 11 towards the downstream side over the stroke "l".

Reference numerals 45 and 46 denote position detecting sensors for detecting the upstream and downstream limits of movement of the above-mentioned sliding piece 33.

The configuration of the cutting device 9 will now be described with reference to FIGS. 1 and 7 to 10.

In the drawings, reference numeral 50 denotes a guide frame mounted on the body frames 16 installed on both sides in a breadthwise direction in such a manner that it may be moved up and down. A movable frame 51 rests on the upper surface of the guide frame 50 in such a manner that it may be moved freely in the direction of feed of the folded paper 3 and in the opposite direction thereof. The guide frame 50 has a rack 52 formed on the lower surface thereof and which meshes with a pinion 53 mounted rotatably on the side of the movable frame 51. The arrangement is made such that when the pinion 53 is rotatively driven the movable frame 51 is moved along the guide frame 50 either in the direction of feed of the folded paper or in the opposite direction thereof.

Provided on both breadthwise sides of the above-mentioned movable frame 51 are a pair of auxiliary guide rails 54 disposed in such a manner that it slopes upward towards the upstream side. Further, a frame 55 for use with the cutting device is mounted on the pair of auxiliary guide rails 54 such that it may be moved freely along the rails 54. The frame 55 for use with the cutting device is comprised of side plates 56 engaged with the auxiliary guide rails 54, and a stay 57 linking both the side plates 56. A rodless cylinder 58 is fixedly secured to the stay 57 in such a manner that its piston may be extended and retracted in a breadthwise direction. The rodless cylinder 58 has a movable body 59 to which a support bed 60 is fixedly secured in such a way as to slope down towards the upstream side. A cutter bed 61 is engaged with the lower leading end portion of the support bed 60 in such a manner that it may be slidably moved up and down freely. And, the cutter bed 61 is connected to a cylinder means 62 fixedly secured to the above-mentioned support bed 60. A cutter 63 is fixedly secured to the cutter bed 61 such that it may be moved in parallel with the directions of movement of the movable body 59. The upstream end face of the cutter 63 slopes downward towards the upstream side so as to form the surface against which the folded paper is urged or pushed.

Connected to the outside of each side plate 56 of the frame 55 for use with the above-mentioned cutting device is a cylinder means 64 mounted on the movable frame 51. The arrangement is made such that when the piston rod in the cylinder means 64 is extended or retracted the frame 55 is moved along the auxiliary guide rails 54 either in the upstream directions or in the downstream direction.

The above-mentioned cutter 63 is of a thickness which permits it to be inserted into the cutter guiding portion 36a of the folded paper separating spatula 36.

Reference numeral 65 indicates a paper level detecting sensor adapted to detect the level of the folded paper 3 at the paper cutting position. The paper level sensor 65 is fixedly secured to the movable frame 1.

As discussed above, the above-mentioned guide frame 51 is mounted on the body frames 16 so that it may be moved up and down relative to the latter. The supporting structure of the guide frame 50 is arranged such that its leg portions 66a and 66b provided on the upstream and downstream sides in the direction of movement of feed of the paper are engaged with the body frame 16 such that they may be slidably moved up and down. The intermediate portion of the guide frame 50 is threadably engaged with an upstanding screw-threaded rod 67 mounted on the side of the body frame 16. The arrangement is made such that the screw-threaded rod 67 can be moved up and down when it is rotated by a worm gear mechanism 68.

The configuration of the sorter device 10 will now be described with reference to FIGS. 1, 7, 9 and 11.

Figure 9:
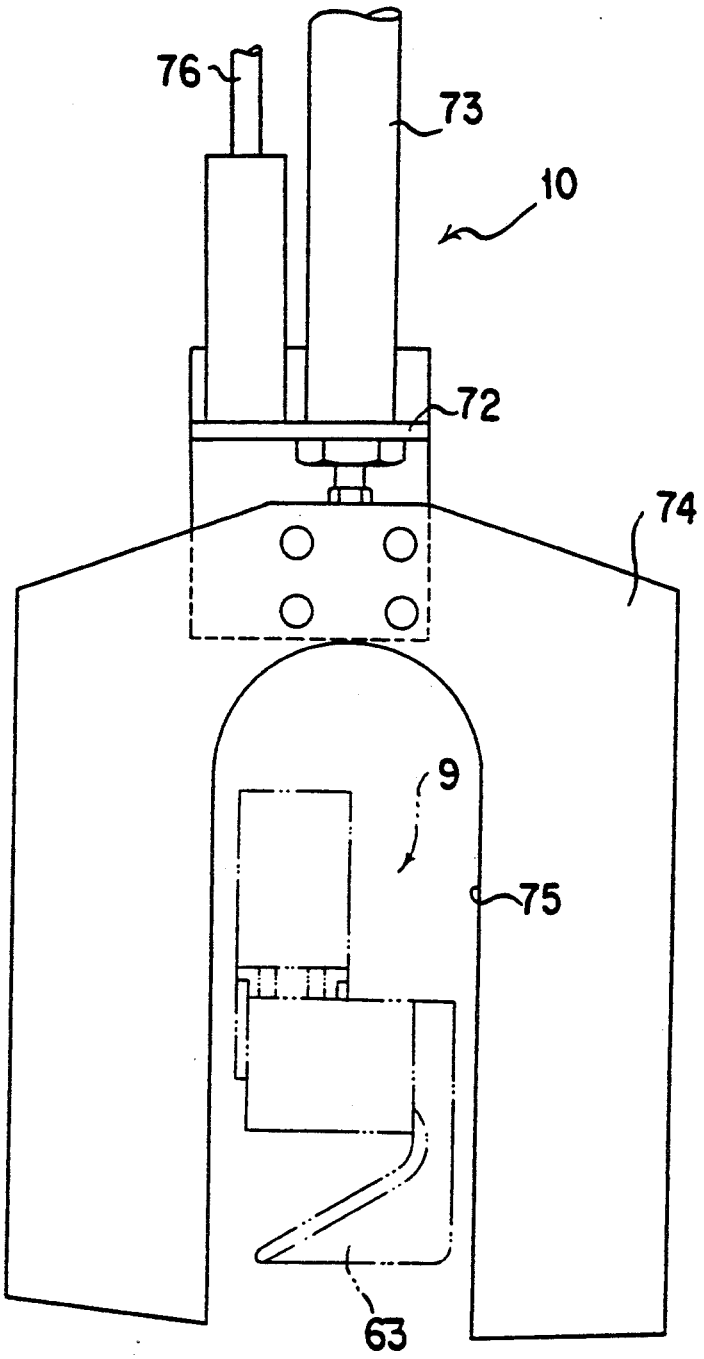
FIG. 9 is a front view showing principal parts of the sorter device.

A support bed 70 is mounted on the movable frame 51 so as to extend in the breadthwise direction of the folded paper 3. Fixedly secured to the support bed 70 is a cylinder means 71 for the purpose of pushing the paper open, which slopes upward towards the upstream side. The cylinder means 71 has a bracket 72 which is fixedly secured thereto, and on which is mounted a cylinder means 73 for comb insertion purposes in such a way as to slope down towards the upstream side. The base end of a plate-shaped comb 74 is fixedly secured to the cylinder means 73 for comb insertion purposes. The above-mentioned comb 74 is forked, as shown in FIG. 9, and has a hollow space 75 formed in the central part thereof, and which allows the cutter 63 of the cutting device 9 to be inserted therein in such a way as not to interfere with each other. The comb 74 of the sorter device 10 is disposed intermediately in the breadthwise direction of the folded paper 3. Reference numeral 76 denotes a guide rod for moving the comb 74 up and down.

The operation of each of the devices having the above-mentioned configurations will now be described below.

(1) Folded Paper Separating Position Indicating Device

By rotating the rotating shaft 13 by the motor 28 so as to forwardly rotate the screw-threaded rod 25 mounted inside the rail 11, the feed pieces 31 and 32 are moved along the rail 11 towards the upstream side. As a result, the sliding piece 33 engaged with the rail 11 is moved towards the upstream side by being pushed by the downstream feed piece 32. When the sliding piece 33 has arrived at a predetermined position on the upstream side, it is detected by the upstream position detecting sensor 45, and according to a command transmitted by the sensor 45, the motor 28 is reversely rotated so as to reversely rotate the screw-threaded rod 25, thereby moving the feed pieces 31 and 32 downstream by the stroke "l" and allowing the upstream feed piece 31 to contact the upstream side surface of the sliding piece 33. Then, the sliding piece 33 is in stand-by condition.

At that time, the folded paper separating spatula 36 is also moved together with the sliding piece 33 towards the upstream side, and upon termination of the movement, the pins 39*a* and 39*b* fitted to the turning lever 35 are brought into contact with the guide cam 40, and the folded paper separating spatula 36 is brought into contact with the guide rod 38, and as a result, the folded paper separating spatula 36 is controlled in this posture so that it may be located in parallel with the rail 11.

Simultaneously with the above-mentioned movement of the sliding piece 33, the elevator device 17 is actuated so as to raise the upstream end portion of the rail 11, thus allowing the rail 11 to slope from the upstream side of the folder unit 1 down towards the cutting device 9.

Figure 2:
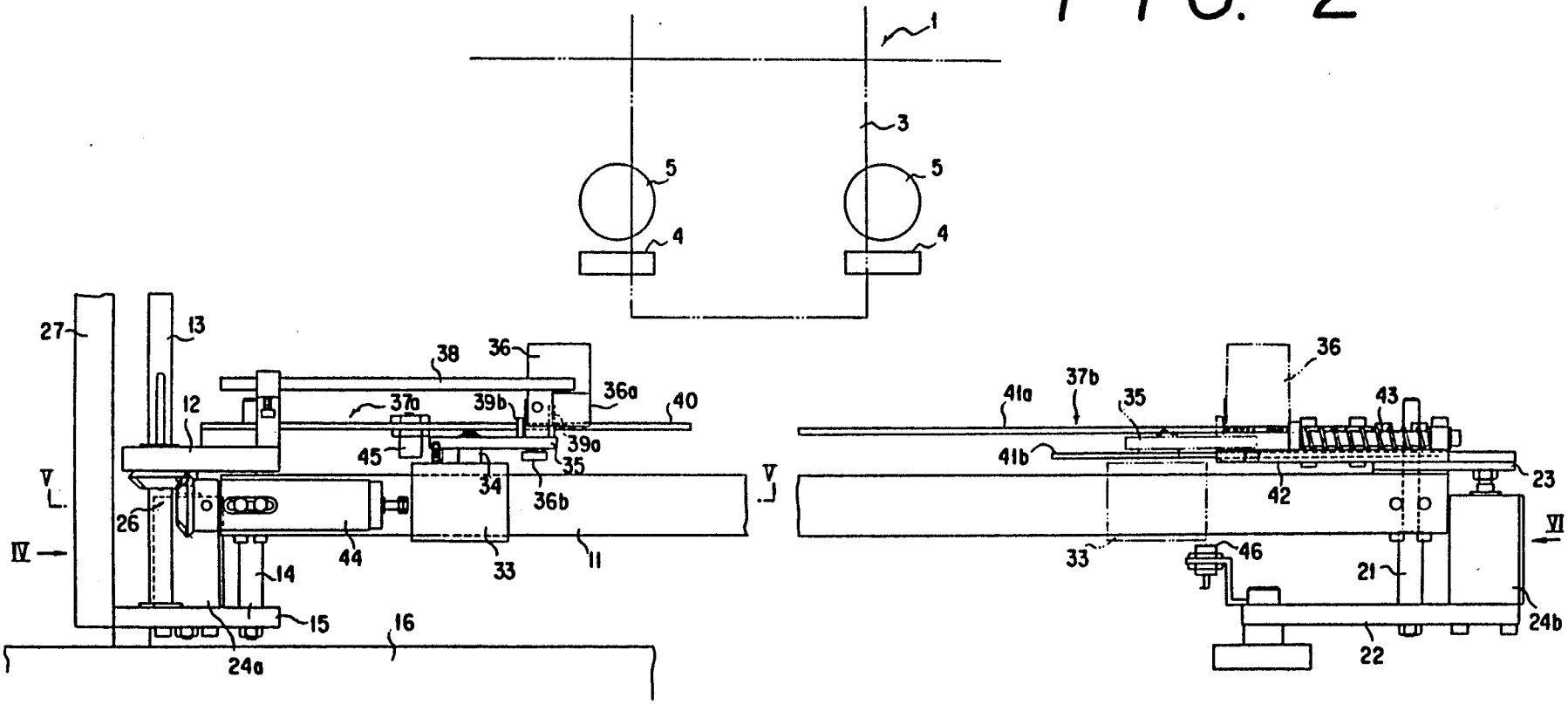
FIG. 2 is a partially cutaway, schematic plan view of one side of the embodiment shown in FIG. 1.
Figure 3:
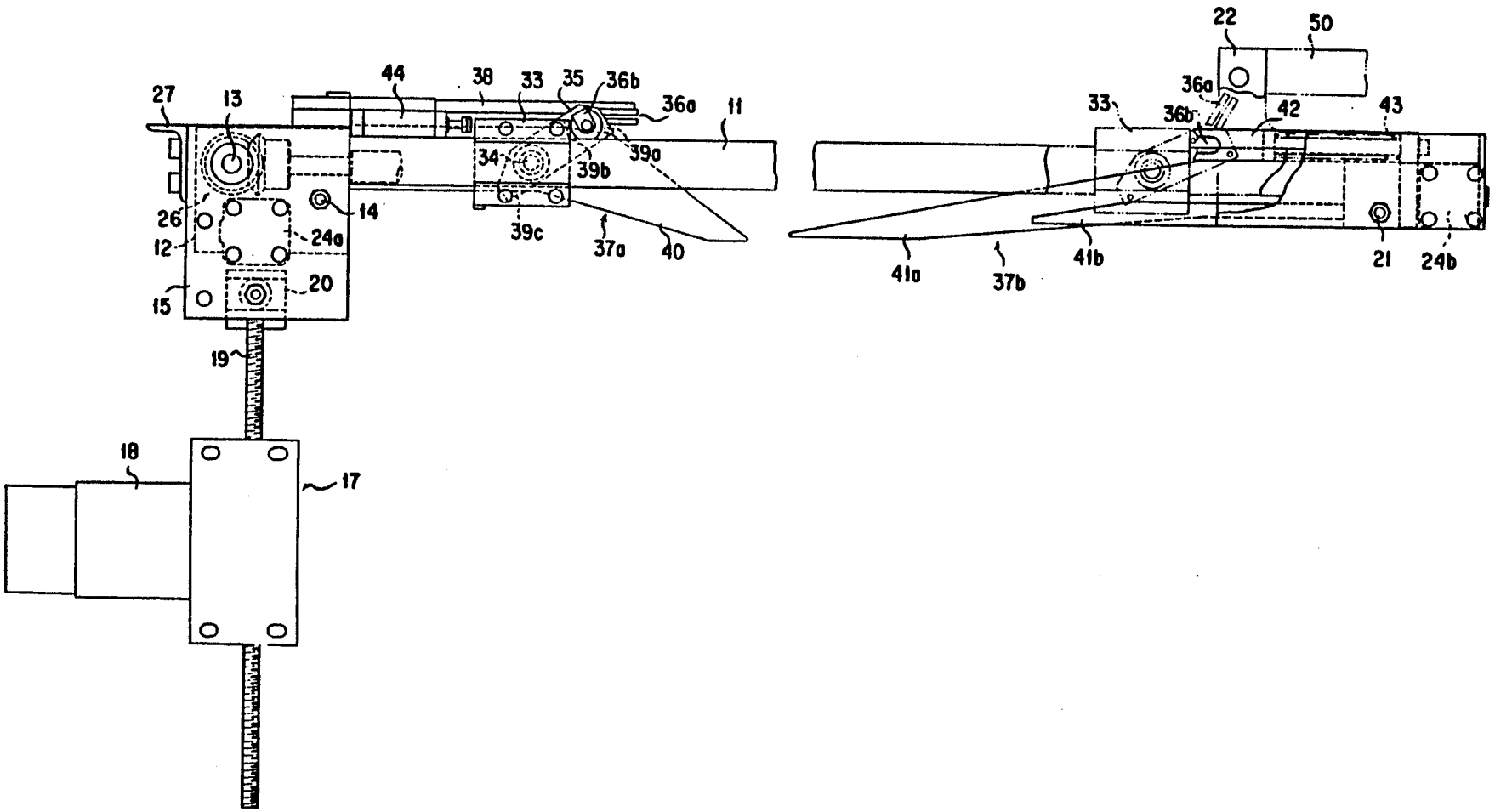
FIG. 3 is a partially cutaway, side elevational view of the embodiment shown in FIG. 1.
Figure 4:
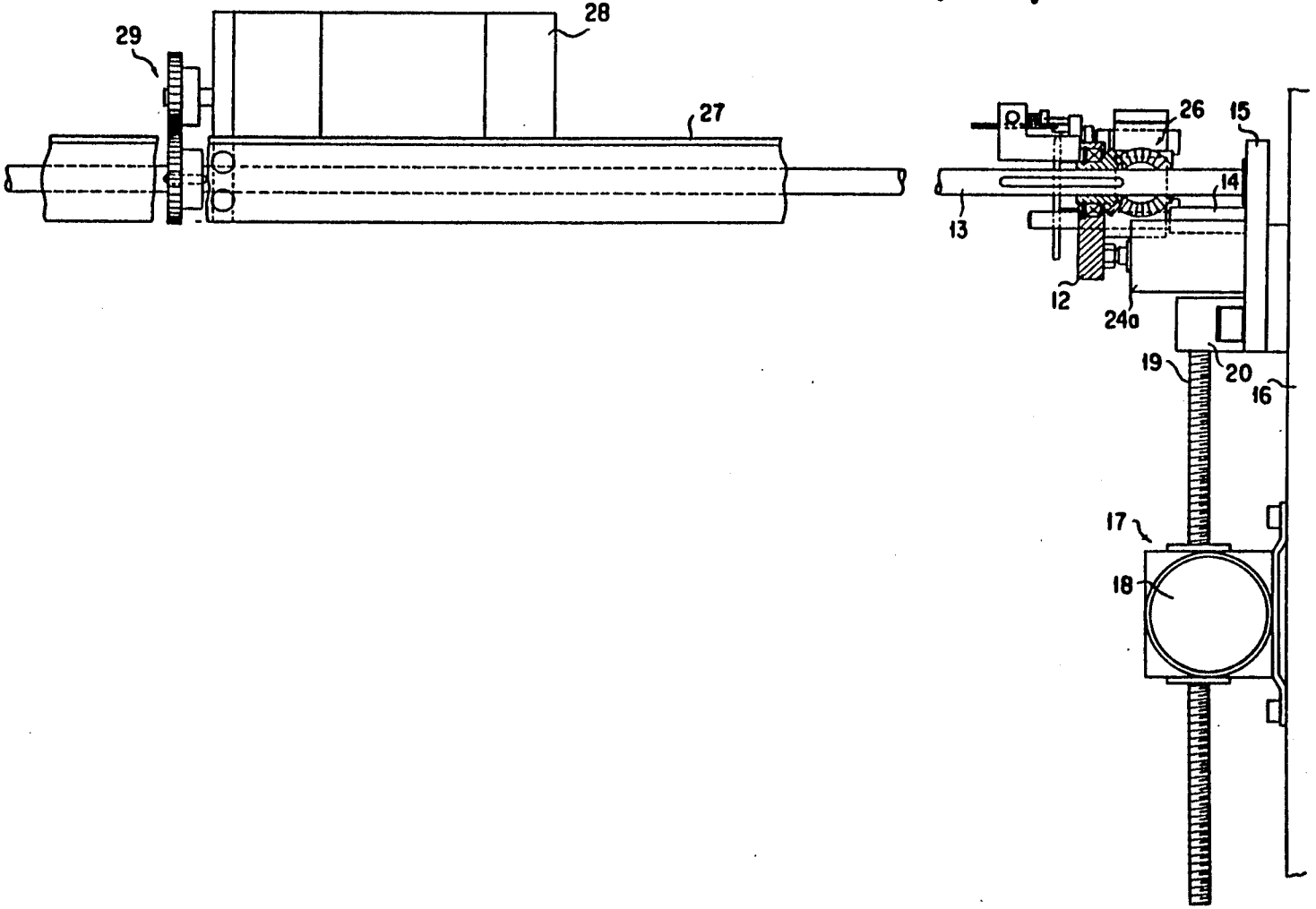
FIG. 4 is a view looking in a direction shown by an arrow IV in FIG. 2.
Figure 5:
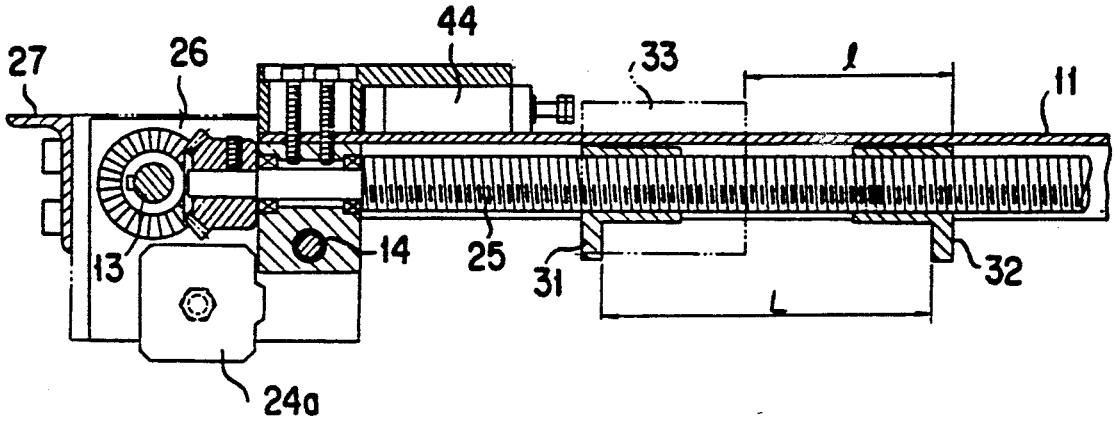
FIG. 5 is a sectional view taken along line V—V in FIG. 2.
Figure 6:
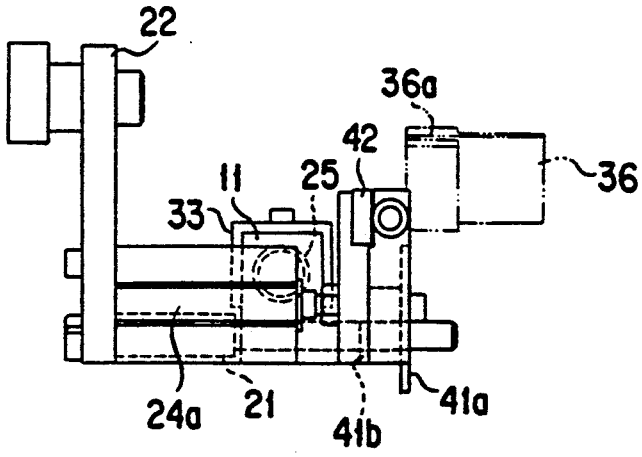
FIG. 6 is a view looking in the direction shown by an arrow VI in FIG. 2.
Figure 7:
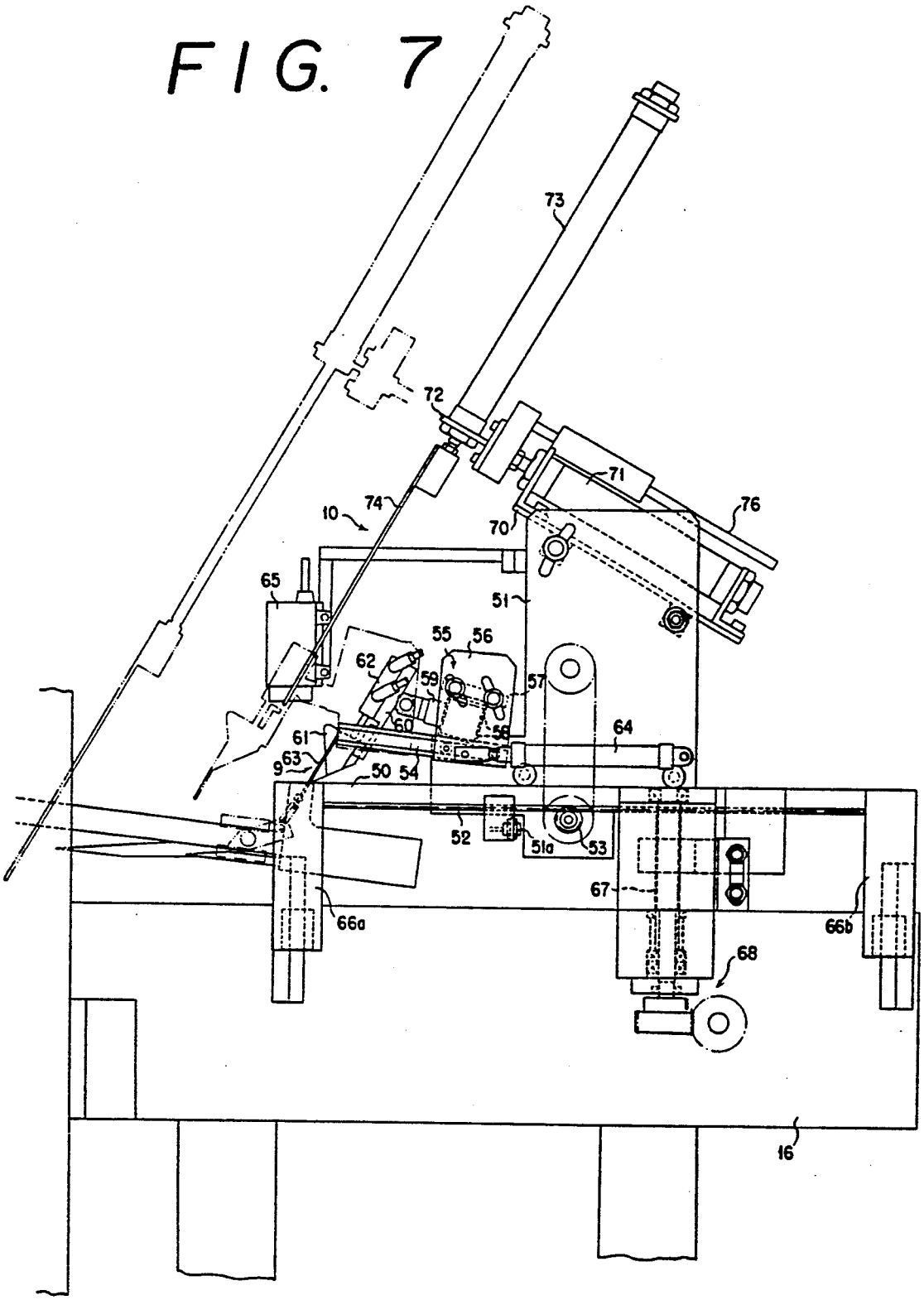
FIG. 7 is a fragmentary side elevational view showing a cutting device and a sorter device.
Figure 8:
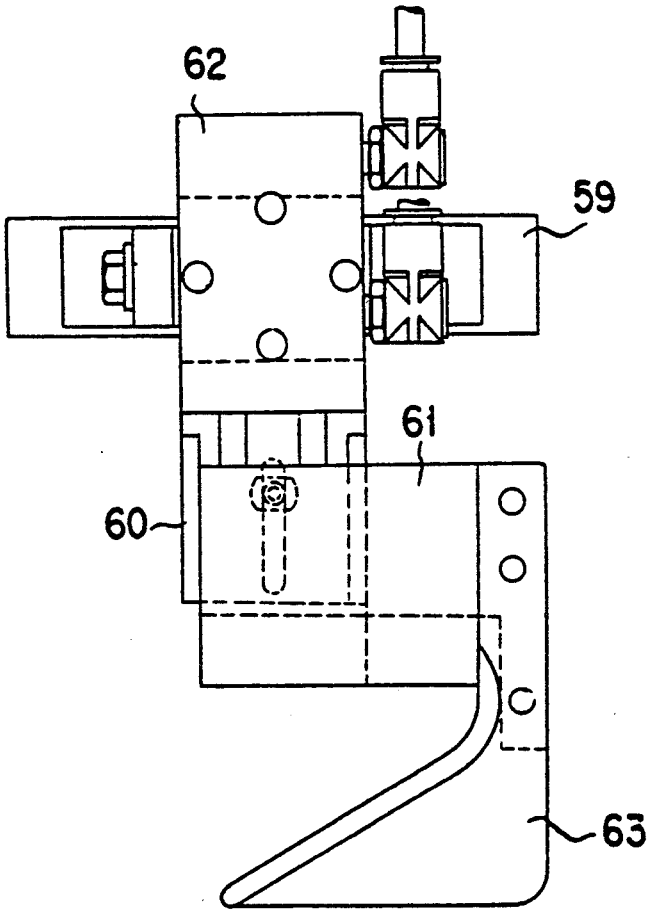
FIG. 8 is a front view showing principal parts of the cutting device.

Thereafter, the piston rods in the offsetting cylinder means 24*a* and 24*b* are extended so as to push the rail 11 out towards the folder unit 1 to thereby move the folded paper separating spatula 36 to a position on the upstream side of the folded paper 3 where it is brought into contact with the paper, as shown by solid line in FIG. 2.

The above-mentioned operation allows the folded paper separating position indicating device 8 to be kept in a stand-by condition.

When it is detected by a sensor, not shown, adapted to detect the number of folds of the paper that the number of folds of the paper 3 discharged from the folder unit 1 has reached a preset value, the cylinder means 44 for spatula insertion purposes is actuated so as to push out the sliding piece 33 towards the downstream side by the idle stroke ( in between both the feed pieces 31 and 32.

As a result, the folded paper separating spatula 36 is inserted into a predetermined fold of the upstream portion of the folded paper 3 which is discharged from the folder unit 1. Simultaneously with the insertion of the spatula 36, the feed motor 28 is driven reversely so as to rotate the screw-threaded rod 25 reversely to thereby move the feed pieces 31 and 32 towards the downstream side at a speed substantially equal to the speed of conveyance of the folded paper by the receiving belt 6, and the conveyor belts 7*a* and 7*b*. As a result, the sliding piece 33 is moved by the upstream feed piece 31 by the idle stroke "l", and then pushed again by the upstream feed piece 31 so that it is moved together with the upstream portion of the folded paper 3 along the rail 11 towards the downstream side.

At that time, the folded paper 3 is conveyed downstream, in turn, obliquely and downwardly from the receiving belt 6 to the conveyor belts 7*a* and 7*b*. Subsequently, the upstream end portion of the rail 11 is lowered gradually by the elevator device 17 until the rail becomes to be disposed horizontally. In consequence, the folded paper separating spatula 36 becomes free of the guide rod 38 and the guide cam 40. The folded paper separating spatula 36 is caught in the peak of a fold of the folded paper 3 at a predetermined position and moved together with the folded paper 3.

When the sliding piece 33 has arrived at a predetermined position on the downstream side, the position detecting sensor 46 detects the arrival and is rendered operative to stop the rotation of the screw-threaded rod 25.

When the sliding piece 33 has come near the downstream terminal point, the turning lever 35 is raised up through the guidance of the two pieces of the guide cams 41*a* and 41*b*, and then the engaging projection 36*b* is engaged with the positioning member 42 with the result that the folded paper separating spatula 36 is stopped and fixed in such a condition as it slopes upward towards the downstream side.

As a result of the above-mentioned operation, a separating position of the paper 3 corresponding to a cutting position thereof is indicated by the folded paper separating spatula 36.

In this condition, the cutter 63 of the cutting device 9 is inserted into the cutter guiding portion 36*a* of the folded paper separating spatula 36, and then the cutter 63 is moved breadthwise so as to cut the folded paper 3, with the paper separating spatula 36 kept in inserted condition.

After the folded paper 3 has been cut, the piston rods in the offsetting cylinder means 24*a* and 24*b* are retracted so as to move the rail 11 outside in the breadthwise direction, and then the screw-threaded rod 25 is rotated forwardly. As a result, the sliding piece 33 is moved by the downstream feed piece 32 back towards the upstream side.

At that time, the folded paper separating spatula 36 is not allowed to interfere with or contact the paper 3.

(2) Cutting Device

During the operation of the above-mentioned separating position indicating device 8, the movable frame 51 is moved upstream to the end of the stroke preset by the sensor 51*a*, and the frame 55 for use with the cutting device is moved towards the downstream side, and further the movable member 59 is moved to this side in the breadthwise direction of the folded paper 3.

In this condition, the cutter 63 of the cutting device 9 is located opposite to the breadthwise outside of the cutter guiding portion 36*a* of the paper separating spatula 36 which is stopped at a predetermined position downstream of the separating position indicating device 8.

By actuating the piston in the rodless cylinder 58 so as to move the movable member 59 in this condition, the cutter 63 is inserted first into the cutter guiding portion 36*a* of the folded paper separating spatula 36, and then moved along a predetermined fold of the folded of the folded paper 3 so as to cut it off.

At that time, the cutter 63 is raised gradually by the action of the cylinder means 62 which is interlocked with the movement of the movable member 59, and as a result a improved sharpness of the cutter is offered thereby cutting the folded paper well.

Figure 10:
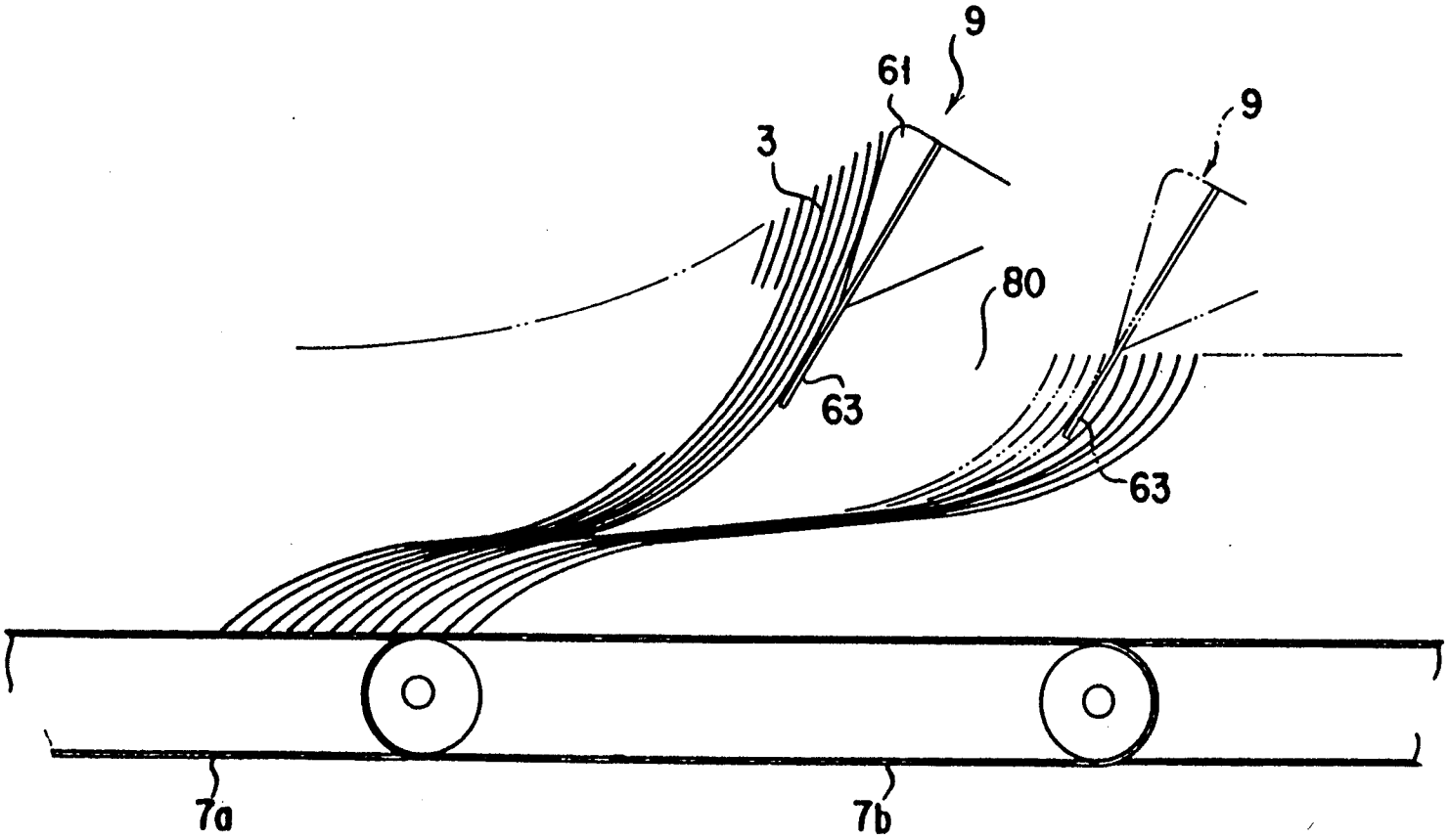
FIG. 10 is an explanatory view showing folded paper separating operation by the cutting device; and, FIG. 11 is an explanatory view showing the sorting operation of the sorter device in cooperation with the cutting device.

After cutting of the paper, the cutter 63 is returned to the breadthwise central part of the folded paper 3, and then the whole cutting device 9 is moved to the upstream side by means of the cylinder means 64. By so doing, as shown in FIG. 10, the portion of the folded paper 3 on the upstream side of the cutting position is pushed by the upstream end surface or the paper pushing surface of the cutter 63 so as to separate the downstream portion of the folded paper from the upstream portion thereof, thus forming a space or clearance 80 downstream of the cutter 63.

During the aforementioned operation, the level of the folded paper 3 varies with the kind of material and folding and discharging speed thereof, etc. The level of the folded paper 3 at that time is detected by a paper level detecting sensor 65, and according to a command transmitted by the sensor 65, the worm gear mechanism 68 is automatically driven so as to move the guide frame 50 up or down to effect control to ensure that the relationship between the level of the folded paper 3 and the positions of the cutter 63 and the paper separating spatula 36 is always kept constant.

(3) Sorter Device

In the condition wherein the space or clearance 80 is defined by the cutting device 9 in the paper flow direction at the paper cutting position, the piston rod in the comb inserting cylinder means 73 of the sorter device 10 is extended so as to insert the comb 74 into the space 80. Subsequently, the piston rod in the folded paper pushing-open cylinder means 71 is extended so as to push the comb 74 towards the upstream side.

Figure 11:
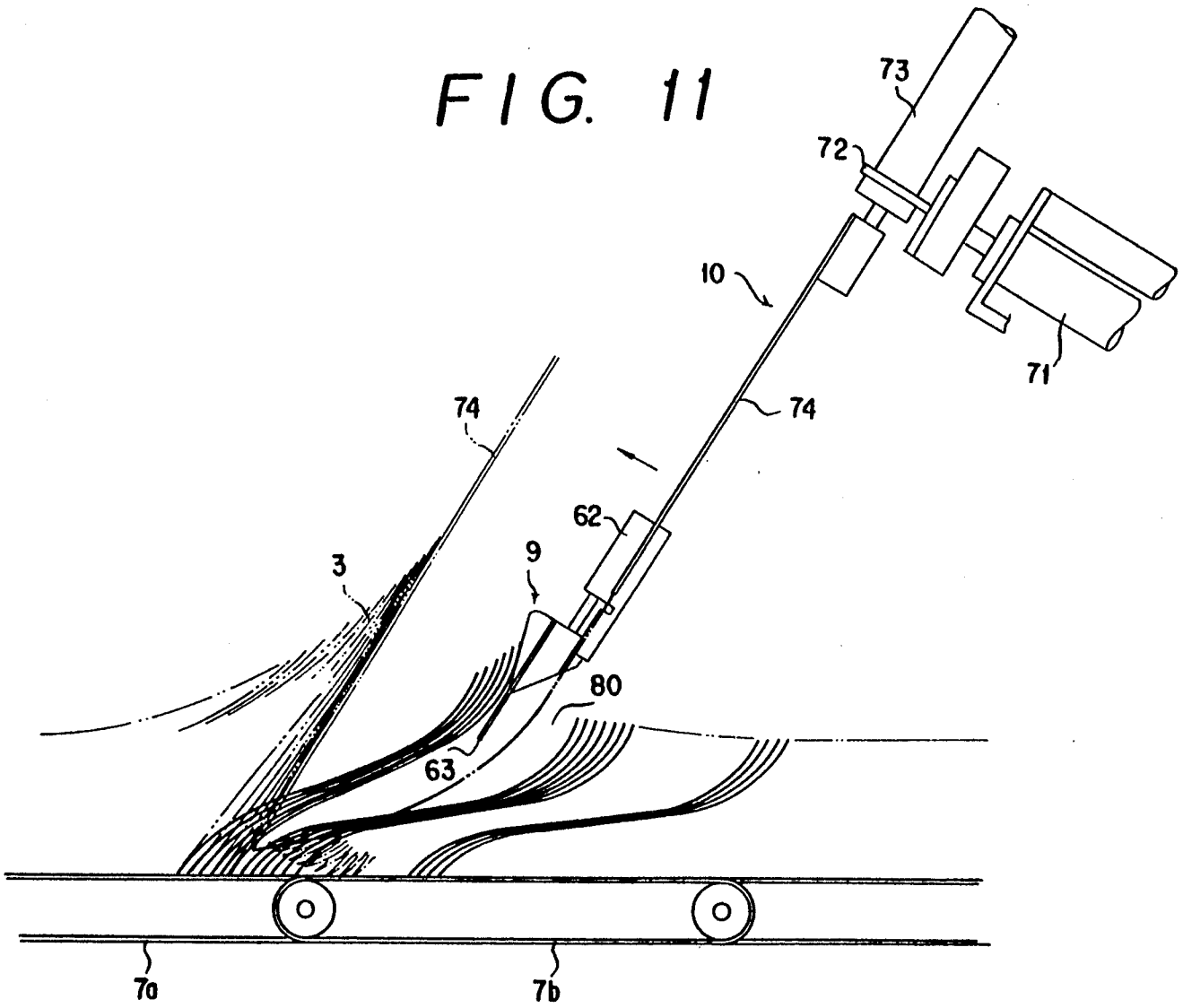

As a result, as shown in FIG. 11, the upstream portion of the paper 3 is sorted out completely from the downstream portion thereof at the cutting position.

Since the downstream portion of the paper sorted out by the above-mentioned sorter device 10 is put on the second conveyor belt **7*b*, the upstream end portion of the second conveyor belt 7*b* is raised so as to slope the belt 7*b* downward towards the downstream side, thereby conveying only the downstream portion of the paper 3 towards the downstream side. The second conveyor belt 7*b*** is then fed quickly.

Further, since even during the sorting operation by the above-mentioned sorter device 10 the paper 3 is continuously sent out from the folder unit 1, the movable frame 51 is moved towards the downstream side in synchronism with the paper discharging speed.

Upon completion of conveyance of the downstream portion of the paper 3 towards the downstream side after completion of the sorting operation, the second conveyor belt **7*b* is returned to the initial horizontal condition, and then the comb 74 of the sorter device 10 is moved upward apart from the folded paper 3, and also the sorter device 10 is returned to the downstream side. At the same time, the cutting device 9 is also returned to its original position. Furthermore, the movable frame 51** is returned to the upstream side.

It is to be understood that the foregoing description is merely illustrative of a preferred embodiment of the present invention, and that the scope of the present invention is not to be limited thereto, but is to be determined by the scope of the appended claims.

What is claimed is:

1. A printed paper folding apparatus comprising:

conveyor means provided from the upstream side of a folded paper conveying path located below a folder unit to a folded paper cutting position on the downstream side thereof so as to convey a sheet of printed paper which is folded and discharged by the folder unit in a zigzag fashion;

a folded paper separating position indicating device provided along said paper conveying path so as to indicate separating positions at intervals of a predetermined number of folds of the printed paper which is folded and discharged by said folder unit, said folded paper separating position indicating device further comprising a printed paper separating spatula generally disposed for reciprocating longitudinal movement and having a cutter guiding portion;

a folded paper cutting device provided at said cutting position so as to automatically cut the printed paper, which is continuously conveyed by said conveyor means along the paper conveying path, into an upstream portion and a downstream portion in relation to said paper conveying path, said folded paper cutting device further comprising a cutter engageable with said printed paper separating spatula; and a folded paper sorting device provided in the vicinity of the cutting position so as to automatically sort out the upstream portion of the paper from the downstream portion thereof at said cutting position, the paper conveying speed of the conveyor means located from said folded paper cutting position to the downstream side being kept higher than that of the conveyor means installed on the upstream side, said folded paper sorting device further comprising a comb plate adapted to be disposed between said upstream and downstream portions.

2. A printed paper folding apparatus comprising:

conveyor means provided from the upstream side of a folded paper conveying path located below a folder unit to a folded paper cutting position on the downstream side thereof so as to convey a sheet of printed paper which is folded and discharged by the folder unit in a zigzag fashion;

a folded paper separating position indicating device provided along said paper conveying path so as to indicate separating positions at intervals of a predetermined number of folds of the printed paper which is folded and discharged by said folder unit, wherein said folded paper separating position indicating device further comprises a pair of rails provided on both breadthwise sides of said folder unit so as to extend the upstream side of said paper conveying path to the downstream side thereof, said rails being arranged such that they may be turned vertically about their downstream end portions as their respective fulcrums, and also moved towards and away from each other in opposite directions in parallel relationship; two pieces of sliding pieces each being slidably engaged with these rails; slidable driving means for slidably moving these sliding pieces along said rails in synchronism with each other; printed paper separating spatulas mounted on these sliding pieces, respectively, such that they may be turned freely, and adapted to be inserted into a predetermined fold of the printed paper, which is folded and discharged by the folder unit, from the upstream side of the paper conveying path; upstream spatula posture control means provided on the upstream end portions of said pair of rails, respectively, so as to control said paper separating spatulas when they are located on the upstream side so that they may assume a posture for insertion into the predetermined fold of the printed paper; downstream spatula posture control means provided on the downstream end portions of said pair of rails, respectively, so as to control said paper separating spatulas when they are located on the downstream side so that they may assume such a posture as to slope upwards towards the downstream side; position detecting sensors provided on the upstream and downstream ends of each of said pair of rails so as to detect the position of said paper separating spatula; and paper separating spatula inserting means provided on the upstream end of each of said pair of rails so as to insert the paper separating spatula into a predetermined fold of the printed paper at intervals of a predetermined number of folds of the printed paper which is folded by the folder unit, when each of said sliding pieces is located at its upstream end;

a folded paper cutting device provided at said cutting position so as to automatically cut the printed paper, which is continuously conveyed by said conveyor means along the paper conveying path, into an upstream portion and a downstream portion in relation to said paper conveying path; and a folded paper sorting device provided in the vicinity of the cutting position so as to automatically sort out the upstream portion of the paper from the downstream portion thereof at said cutting position.

3. A printed paper folding apparatus comprising:

conveyor means provided from the upstream side of a folded paper conveying path located below a folder unit to a folded paper cutting position on the downstream side thereof so as to convey a sheet of printed paper which is folded and discharged by the folder unit in a zigzag fashion;

a folded paper separating position indicating device provided along said paper conveying path so as to indicate separating positions at intervals of a predetermined number of folds of the printed paper which is folded and discharged by said folder unit;

a folded paper cutting device provided at said cutting position so as to automatically cut the printed paper, which is continuously conveyed by said conveyor means along the paper conveying path, into an upstream portion and a downstream portion in relation to said paper conveying path, wherein said folded paper cutting device further comprises guide frames extending further downstream from the downstream ends of said pair of rails located in the vicinity of said folded paper cutting position, each of said guide frames being fixedly secured to the upper end of each of a pair of upstanding leg portions mounted on a body frame in such a manner that they may be slidably moved up and down from the body frame; a movable frame mounted on the upper surfaces of the guide frames in such a manner that it may be moved freely in the direction of conveyance of the printed paper and in the opposite direction thereof; a cutter bed provided on the upstream side of the movable frame in such a manner that it may be moved transversely or widthwise in a range longer than the width of the printed paper; a cutter fixedly secured to the cutter bed in such a manner that it may assume a posture coincident with the posture of the paper separating spatulas, respectively, located at the downstream ends of said rails when the cutter bed is located at its downstream end position; guide frame moving means for moving up and down the pair of leg portions whose top ends are fixedly secured to said guide frames; a cutter bed moving means for moving the cutter bed longitudinally and transversely of the direction of conveyance of the folded paper; and a folded paper level detecting sensor fixedly secured to said movable frame so as to project therefrom towards the upstream side and adapted to detect the level of the folded paper at said folded paper cutting position; and a folded paper sorting device provided in the vicinity of the cutting position so as to automatically sort out the upstream portion of the paper from the downstream portion thereof at said cutting position.

4. A printed paper folding apparatus comprising:

conveyor means provided from the upstream side of a folded paper conveying path located below a folder unit to a folded paper cutting position on the downstream side thereof so as to convey a sheet of printed paper which is folded and discharged by the folder unit in a zigzag fashion;

a folded paper separating position indicating device provided along said paper conveying path so as to indicate separating positions at intervals of a predetermined number of folds of the printed paper which is folded and discharged by said folder unit;

a folded paper cutting device provided at said cutting position so as to automatically cut the printed paper, which is continuously conveyed by said conveyor means along the paper conveying path, into an upstream portion and a downstream portion in relation to said paper conveying path; and a folded paper sorting device provided in the vicinity of the cutting position so as to automatically sort out the upstream portion of the paper from the downstream portion thereof at said cutting position, wherein said folded paper sorter device further comprises guide frames extending further downstream from the downstream ends of said pair of rails located in the vicinity of said folded paper cutting position, each of said guide frames being fixedly secured to the upper end of each of a pair of upstanding leg portions mounted on a body frame in such a manner that they may be slidably moved up and down from the body frame; a movable frame mounted on the upper surfaces of the guide frames in such a manner that it may be moved freely in the direction of conveyance of the printed paper and in the opposite direction thereof; a cutter bed provided on the upstream side of the movable frame in such a manner that it may be moved transversely or widthwise in a range longer than the width of the printed paper; a cutter fixedly secured to the cutter bed in such a manner that it may assume a posture coincident with the posture of the paper separating spatulas, respectively, located at the downstream ends of said rails when the cutter bed is located at its downstream end position; guide frame moving means for moving up and down the pair of leg portions whose top ends are fixedly secured to said guide frames; a cutter bed moving means for moving said cutter bed longitudinally and transversely of the direction of conveyance of the folded paper; a folded paper level detecting sensor fixedly secured to said movable frame so as to project therefrom towards the upstream side and adapted to detect the level of the folded paper at said folded paper cutting position; and an inverted-U shaped comb plate mounted on said movable frame in such a manner that it may be moved vertically, and also from an inserting position towards the upstream side through the action of driving means so as to be inserted from above in between the upstream and downstream portions of the paper, which have been cut off, at a position downstream of the cutter when said cutter bed is moved to its upstream end position and also moved to the breadthwise intermediate position of the printed paper, and wherein the paper conveying speed of the conveyor means located from said folded paper cutting position to the downstream side is kept higher than that of the conveyor means installed on the upstream side.

* * * * *